US008367951B2

(12) United States Patent
Nilsson et al.

(10) Patent No.: US 8,367,951 B2
(45) Date of Patent: Feb. 5, 2013

(54) VACUUM BASED DIVERTER SWITCH FOR TAP CHANGER

(75) Inventors: Petter Nilsson, Ludvika (SE); Robert L. Hirt, Cary, NC (US); Hans Johansson, Ludvika (SE); Mats Carlsson, Ludvika (SE); Lars Jonsson, Ludvika (SE)

(73) Assignee: ABB Technology Ltd., Zürich (CH)

( * ) Notice: Subject to any disclaimer, the term of this patent is extended or adjusted under 35 U.S.C. 154(b) by 386 days.

(21) Appl. No.: 12/438,375

(22) PCT Filed: Aug. 23, 2007

(86) PCT No.: PCT/US2007/018596

§ 371 (c)(1),
(2), (4) Date: Aug. 16, 2010

(87) PCT Pub. No.: WO2008/024417

PCT Pub. Date: Feb. 28, 2008

(65) Prior Publication Data

US 2011/0031220 A1 Feb. 10, 2011

Related U.S. Application Data

(60) Provisional application No. 60/839,429, filed on Aug. 23, 2006.

(51) Int. Cl.
*H01H 3/32* (2006.01)

(52) U.S. Cl. ..... 200/6 R; 631/1

(58) Field of Classification Search ..... 200/6 R; 631/1

See application file for complete search history.

(56) References Cited

U.S. PATENT DOCUMENTS

| | | | | |
|---|---|---|---|---|
| 4,348,558 | A * | 9/1982 | Johansson | 200/6 R |
| 4,573,228 | A * | 3/1986 | Bachalo | 449/51 |
| 6,856,122 | B2 | 2/2005 | Dohnal et al. | |
| 2005/0099741 | A1 * | 5/2005 | Stenestam et al. | 361/1 |
| 2005/0269191 | A1 | 12/2005 | Lindsey et al. | |
| 2010/0090794 | A1 * | 4/2010 | Nilsson et al. | 338/261 |

FOREIGN PATENT DOCUMENTS

| | | | |
|---|---|---|---|
| DE | 4407945 | C1 | 10/1995 |
| EP | 116748 | A1 * | 8/1984 |
| GB | 1293060 | A | 10/1972 |
| JP | 2000-340435 | * | 12/2000 |

OTHER PUBLICATIONS

PCT/ISA/210—International Search Report—Jul. 25, 2008.

* cited by examiner

*Primary Examiner* — Truc Nguyen

(74) *Attorney, Agent, or Firm* — Venable LLP; Eric J. Franklin

(57) ABSTRACT

A retrofit diverter switch which has a mechanical and electrical interface that is compatible with the existing designs is provided. The diverter switch may include a vacuum switch. The feature where the mechanical and electrical interface is compatible enables a retrofit from traditional On Load Tap Changers to a vacuum based on Load Tap Changers. The diverter switch may be retrofitted into existing tap changer housings. Retrofitting from traditional to vacuum based, traditional to vacuum based and up rating, and vacuum up rating may be possible. Also, the diverter switch may include modular components that allow for easy customization of the diverter switch for different applications.

10 Claims, 7 Drawing Sheets

VACUUM BASED DIVERTER SWITCH FOR TAP CHANGER

CROSS-REFERENCE TO RELATED APPLICATIONS

This application claims priority to U.S. provisional patent application 60/839,429 filed 23 Aug. 2006 and is the national phase under 35 U.S.C. §371 of PCT/US2007/018596 filed 23 Aug. 2007.

BACKGROUND OF THE INVENTION

High voltage and medium voltage transformers are widely used in electrical power distribution of today. Utilizing the magnetic features of electrical currents, they transfer power between two or more incompatible electrical AC-circuits. Thereby, power from a power plant can be transported by a small current of very high voltage and then stepped down to a large current of low voltage before reaching customers.

Supply authorities are under an obligation to their customers to maintain the supply voltage between certain limits. A tap changer is a device used in a transformer for regulation of the transformer output voltage within these limits. Normally, this is achieved by changing the ratios of the transformers of the system by altering the number of turns in one winding of the appropriate transformer(s). This ratio determines the voltage ratio between the windings and is essential for the stabilization of network voltage under variable load conditions. The tap changer changes the turn ratio between windings in a transformer. An on-load tap changer (OLTC) normally has a regulation range of ±20% of the total line voltage; regulation is performed in roughly 9 to 35 steps and operated 10 to 20 times a day in normal grid applications. For very demanding systems, such as melting furnaces, there may be hundreds of such operations per day.

A lower load on the system may for instance require that tap-changing operations decrease the number of turns in the winding. This ultimately results in an increased output voltage as compared to if no tap changing were performed.

Besides the described application, tap changers may also be used in connection with other inductive power devices such as reactors. Tap changers are either on-load, i.e. operating while the transformer is energized, or off-load and there is a wide range of models available. A tap changer generally comprises a number of switches for tap changing and a number of resistors or other impedances to prevent short-circuiting. Furthermore, the tap changer typically is filled with an insulating liquid, such as oil, which besides insulation offers cooling of the device.

There is also a large demand for tap changers used in industrial transformers in rectifier and furnace applications. In some applications the tap changer may perform several hundred thousand switching operations per year. Phase Shifting Transformers (Management of power flow in AC networks) and Transformers for High Voltage Direct Current (for long distance transmission and coupling of unsynchronized networks) transmission are two other areas where there is an emphasis on voltage regulation.

Power utilities throughout the world are constantly seeking to improve the economic and technical performance of their assets. Needless to say the two go hand in hand and because of the size of the investments required and the long life expectancy of power grid installations there is a healthy skepticism in the industry to new and unproven technology. The emergence of mature vacuum technology is a response to the need for more efficient asset utilization.

SUMMARY OF THE INVENTION

Embodiments of the present invention provide a diverter switch comprising an interface to mate with an existing tap changer housing to allow retrofitting of the diverter switch; main contacts; transition contacts; a transition resistor mount coupled to the transition contacts; a transition resistor module having a interface to mate with the transition resistor mount, wherein a plurality of transition resistor modules may be coupled together.

A further embodiment of the invention provides a diverter switch for a tap changer, the diverter switch comprising: main contact; transition contacts; a vacuum switch disposed to quench arcing when switching between the main contacts and the transition contacts.

BRIEF DESCRIPTION OF THE DRAWINGS

The accompanying drawings, which are incorporated herein and form part of the specification, illustrate embodiments of the present invention and, together with the description, further serve to explain the principles of embodiments of the invention.

It should be understood that these figures depict embodiments of the invention. Variations of these embodiments will be apparent to persons skilled in the relevant art(s) based on the teachings contained herein.

DETAILED DESCRIPTION OF THE INVENTION

Embodiments of the invention are discussed in detail below. In describing embodiments, specific terminology is employed for the sake of clarity. However, the invention is not intended to be limited to the specific terminology so selected. While specific exemplary embodiments are discussed, it should be understood that this is done for illustration purposes only. A person skilled in the relevant art will recognize that other components and configurations can be used without parting from the spirit and scope of the invention.

Embodiments of the invention provide a diverter switch using vacuum based switching technology, for example, vacuum switches. Embodiments may also provide a "modular" diverter switch, that is, a diverter switch in which parts of the diverter switch may be swapped out to allow for customization of a base diverter switch. For example, among other parts, modular transition resistors may be provided. The modular transition resistors may be switched or connected in different arrangements in order to customize the base diverter switch.

Embodiments may also provide a diverter switch which has a mechanical and electrical interface that is compatible with the existing designs. The feature where the mechanical and electrical interface is compatible enables a retrofit from traditional On Load Tap Changers to vacuum based on Load Tap Changers. The diverter switch may be retrofitted into existing tap changer housings. Retrofitting from traditional to vacuum based, traditional to vacuum based and up rating, and vacuum up rating may be possible.

Benefits of the disclosed diverter switch may include higher electrical ratings at the same physical size, longer contact life at the same rated load and also increased time based maintenance intervals due to reduced pollution and destruction of the oil. Additionally, the maintenance driving parts, both electrical and mechanical, are mainly found on the diverter switch. By changing to a vacuum based diverter switch it may be possible to prolong intervals between maintenance and potentially also remove the need for contact exchange (depending on application and total number of operations during life).

Figure 1:
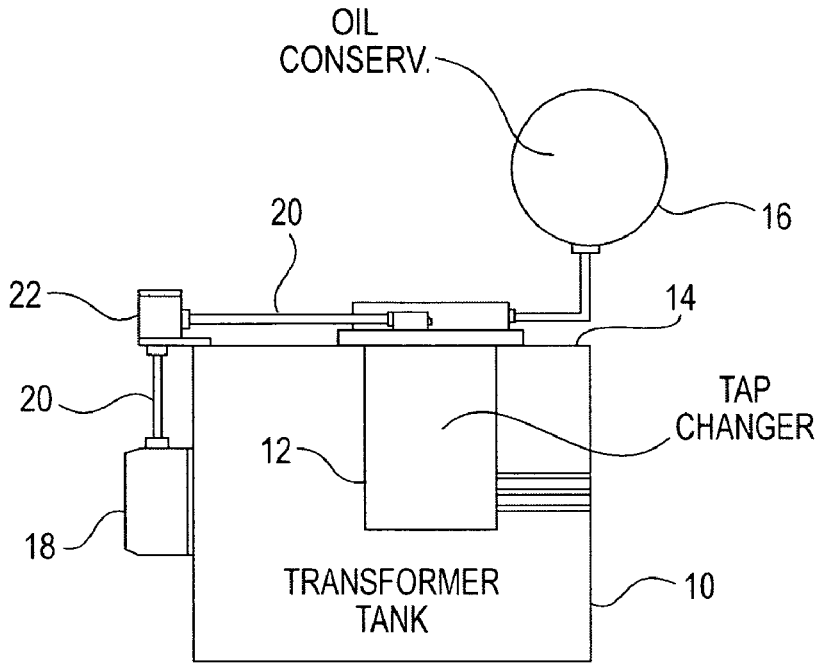
FIG. 1 is a diagram of a transformer according to an exemplary embodiment of the present invention.

FIG. 1 is a schematic illustration of a transformer with a tap changer system which may be used with embodiments of the present invention. A transformer tank 10 comprising a tap changer 12 is shown. The illustrated tap changer 12 is suspended from a transformer cover 14, but other tap changers 12 may be arranged outside the transformer tank 10. Both the transformer tank 10 and the tap changer 12 are filled with an insulating liquid, preferably oil, stored in an oil conservator 16. To avoid contamination of transformer oil, e.g. from arcing which will be described below, the tap changer 12 has a tight housing separating its insulating liquid from the transformer insulating liquid. Power to operate the tap changer 12 is supplied from a motor-chive mechanism 18, which is mounted on the outside of the transformer tank 10. The power is transmitted by means of shafts 20 and bevel gears 22.

Figure 2:
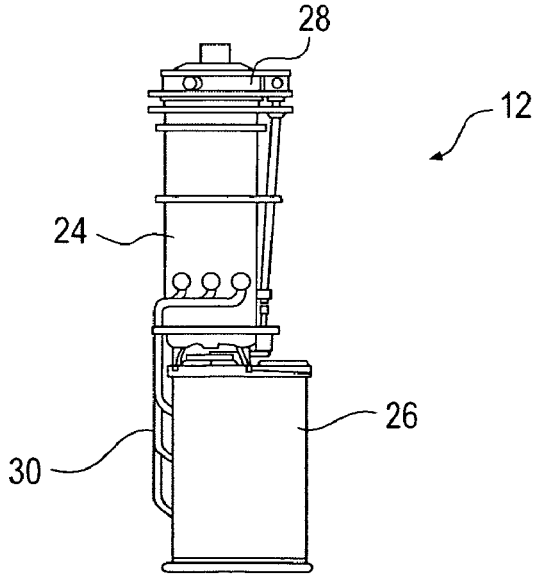
FIG. 2 is a diagram of a transformer according to an exemplary embodiment of the present invention.

FIG. 2 is a schematic view of an on-load tap changer, which may be used with embodiments of the present invention. The illustrated tap changer 12 is formed of two main parts, a diverter switch 24 and a tap selector 26, interrelated by connections 30. The diverter switch 24 may include a conventional top housing 28.

In operation of the tap changer there are contact breaks in the diverter switch 24 during the tap switching sequence. As the contacts break, the high voltage gives rise to arcing. In a successful switching operation, the life of an arc is completed within one half-cycle (max 10 ms at 50 Hz). In traditional tap changers, the arcing takes place within the insulating liquid and causes thermal degradation of the insulating liquid, resulting in formation of volumes filled with gas. One consequence of this is that the gas formation in turn leads to sudden pressure changes in the insulating liquid. Another consequence of the thermal degradation is that the insulating liquid is contaminated.

As noted above, exemplary embodiments of the present invention provide a diverter switch that includes a vacuum switch, such as a vacuum interrupter. In an exemplary embodiment of the invention, the arcing that takes place during tap switching is now quenched in the vacuum switch, instead of in the insulating liquid, as is the case in traditional diverter switches. Thus, the arcing takes place within the vacuum switch. This may reduce or eliminate the degradation of the insulating oil and the associated maintenance costs. In addition, vacuum interrupters have several technical advantages thanks to their fast dielectric recovery. This facilitates better optimization of tap-changers for each application and thus improves cost effectiveness and reduces the overall size of the transformer. Advantages of vacuum switches may include improved arc quenching capability in demanding applications such as, phase shifting transformers, series reactors, industrial transformers and SVC transformers.

Embodiments of the present invention provide a diverter switch that utilizes the vacuum switches. The arcing described above is confined inside the vacuum switches. This improves the operation and longevity of the tap changer. Typically, maintenance and replacement of tap changers depends on the time and number of switching operations. The time factor is mainly dependent on pollution and degradation of the insulating capabilities of the oil and the tap changer. The pollution and insulation capabilities of the oil are dependent on the particle and moisture content, both of which may be reduced by having the electric arcs enclosed in the vacuum switch. The number of operations factor is largely related to the wear of the arcing contact. The wear rate is reduced when the arching occurs in the vacuum switch, where part of metal that evaporated during arcing condenses back to the contact.

Figure 3:
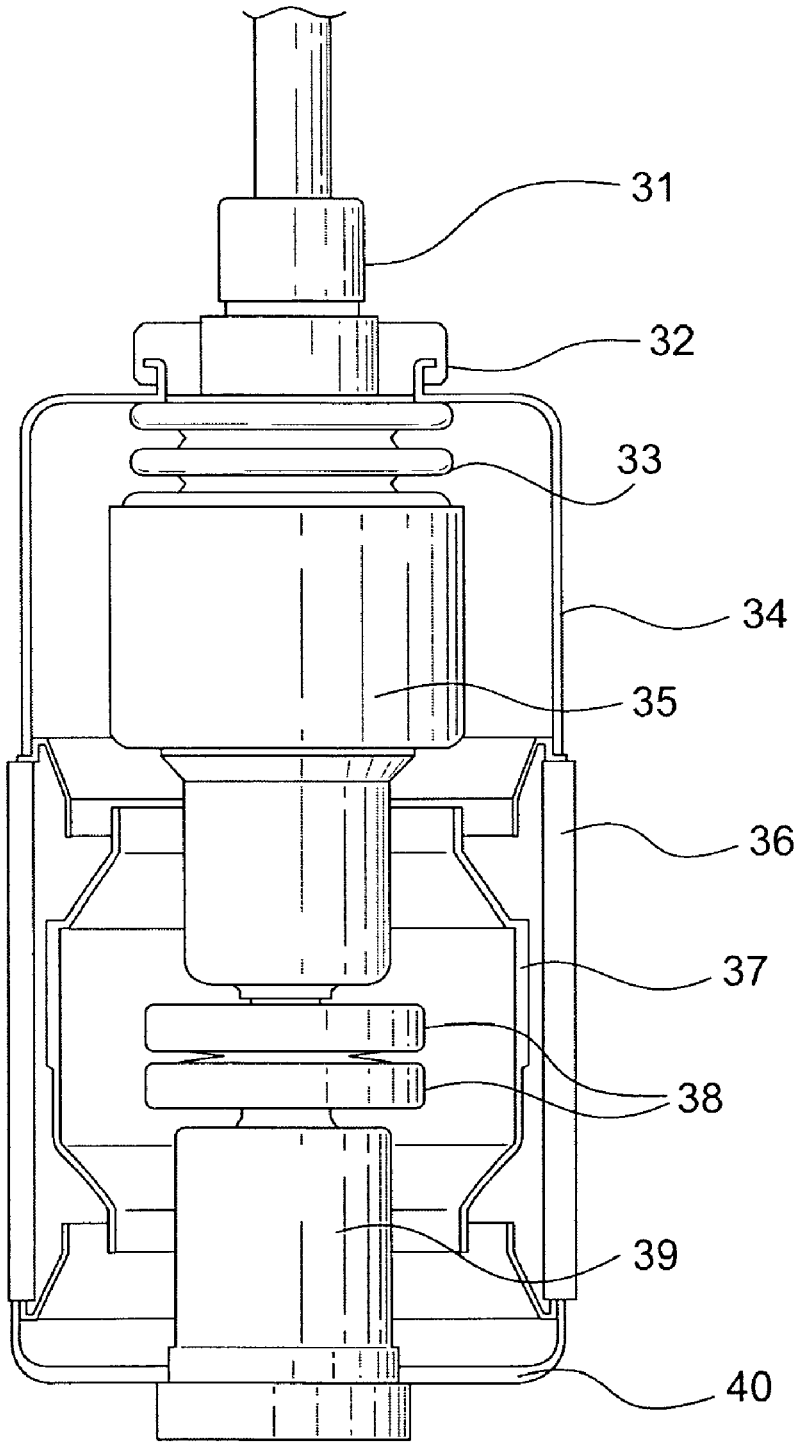
FIG. 3 is a diagram of a vacuum switch according to an exemplary embodiment of the present invention.

FIG. 3 illustrates an example of a vacuum switch that may be used in an exemplary diverter switch. The vacuum switch may include a first end and a second end. A terminal 31 may be disposed at the first end and a stem 39 at the second end. Both the terminal 31 and the stem 39 extend from a housing of the vacuum switch. The housing may be formed by an interrupter lid 34 which is coupled to a ceramic insulator 36. A second interrupter lid 40 may be formed around the stem 39 to seal the vacuum switch. Twist protection 32 may be provided at the first end of the vacuum switch around the terminal 31 to seal the vacuum switch. The terminal 31 may be connected to a metal bellows 33. The metal bellows 33 may be coupled to a shield 35. Contacts 38 may be arranged within the vacuum switch housing. The arcing that occurs during switching is between these contacts within the vacuum switch. One of the two contacts 38 is coupled to the stem 39. A shield 37 may be disposed within the housing around the contacts 38.

Figure 4:
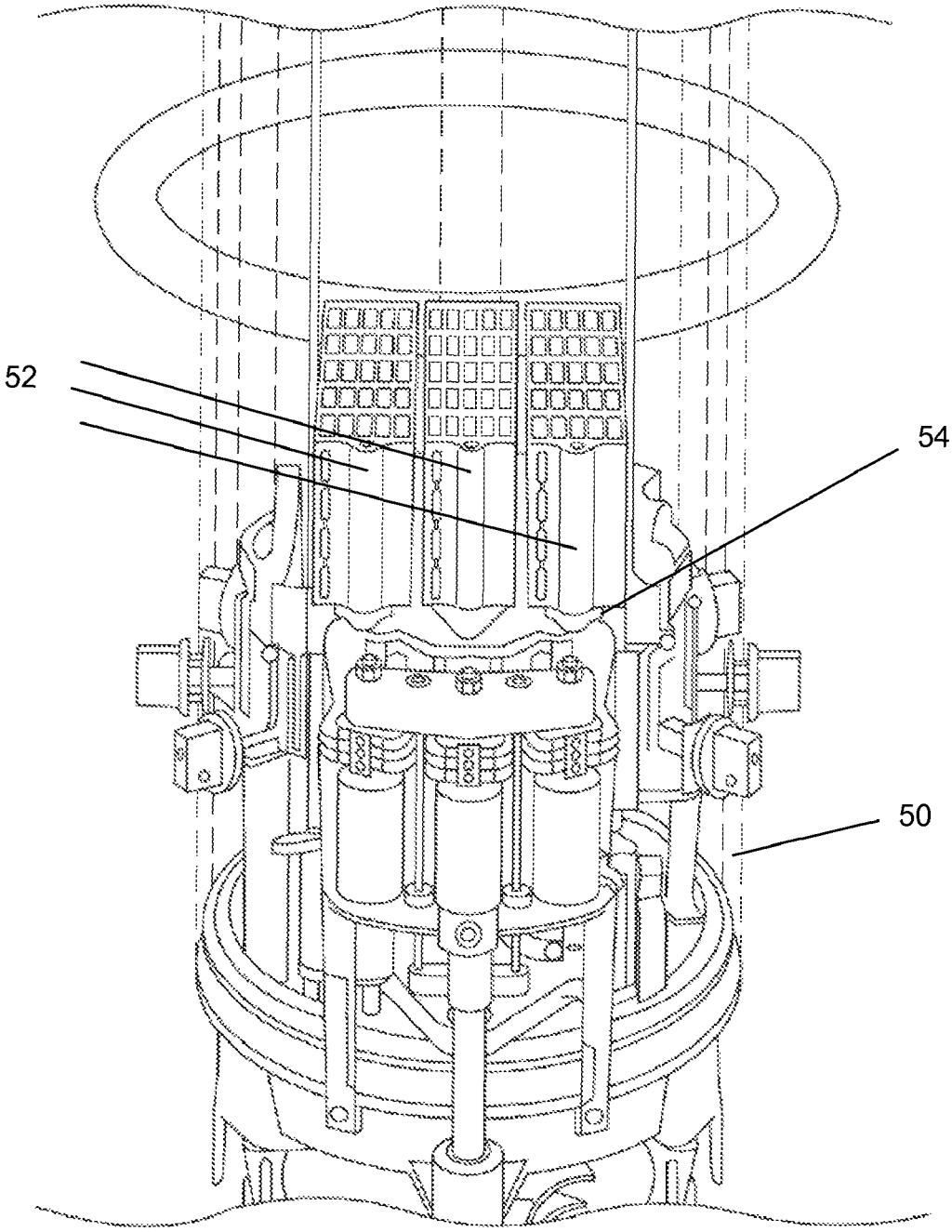
FIG. 4 is a diagram of a diverter switch according to an exemplary embodiment of the present invention.

FIG. 4 illustrates an example of a diverter switch including the vacuum switches depicted in FIG. 3. In the illustrated diverter switch, the electrical and mechanical circuits are separated.

Figure 5A:
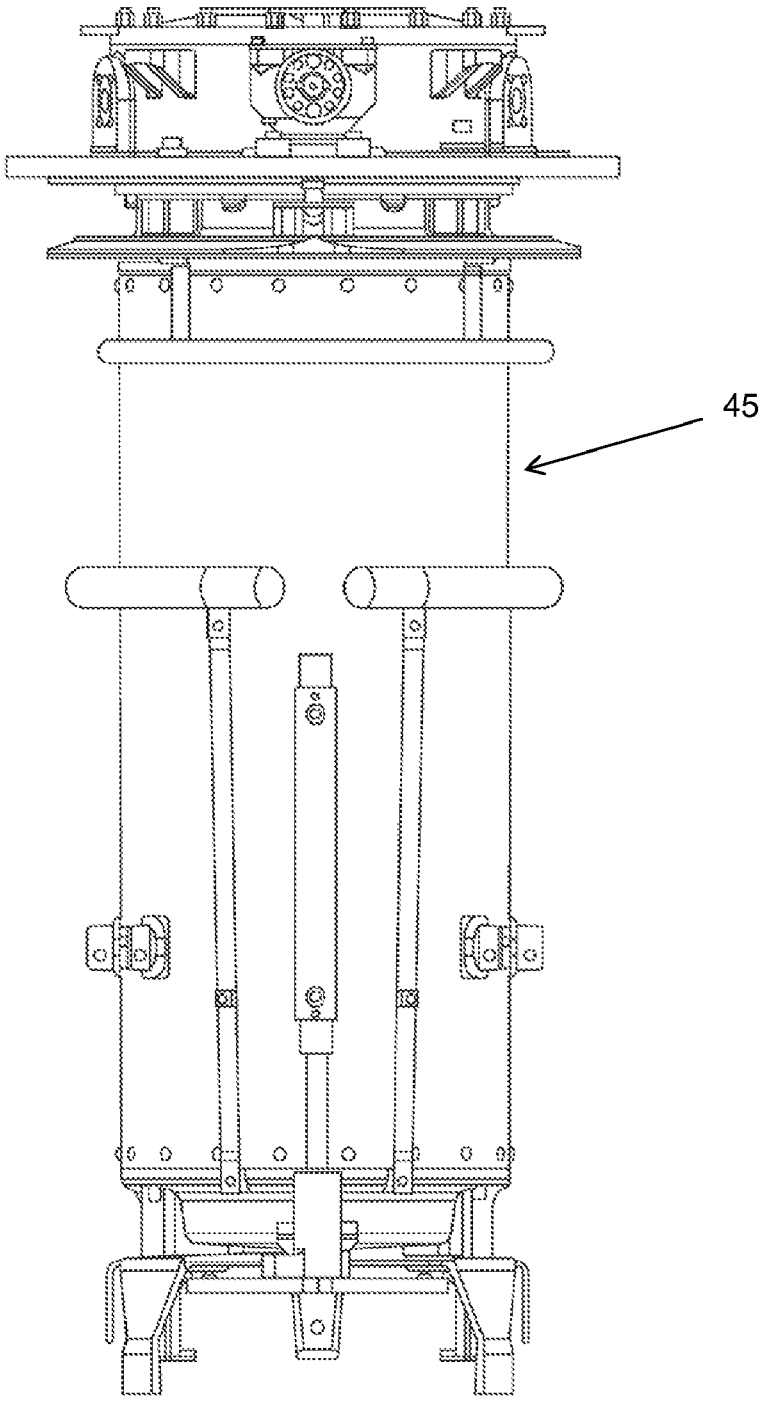
FIG. 5A is a diagram of a housing according to an exemplary embodiment of the present invention.

The diverter switch illustrated in FIG. 4 may be retrofitted into existing tap changer housing. For example, the tap changer illustrated in FIG. 1 includes a housing which houses the diverter switch. An example housing 45 is shown in FIG. 5A. The existing diverter switch within the housing 45 may be removed and replaced with a vacuum based diverter switch. The replacement vacuum-based diverter switch may simply be slid into the housing 45 and connected into place. As such, the replacement diverter switch should be capable of interfacing with the existing connections in the housing.

Figure 5B:
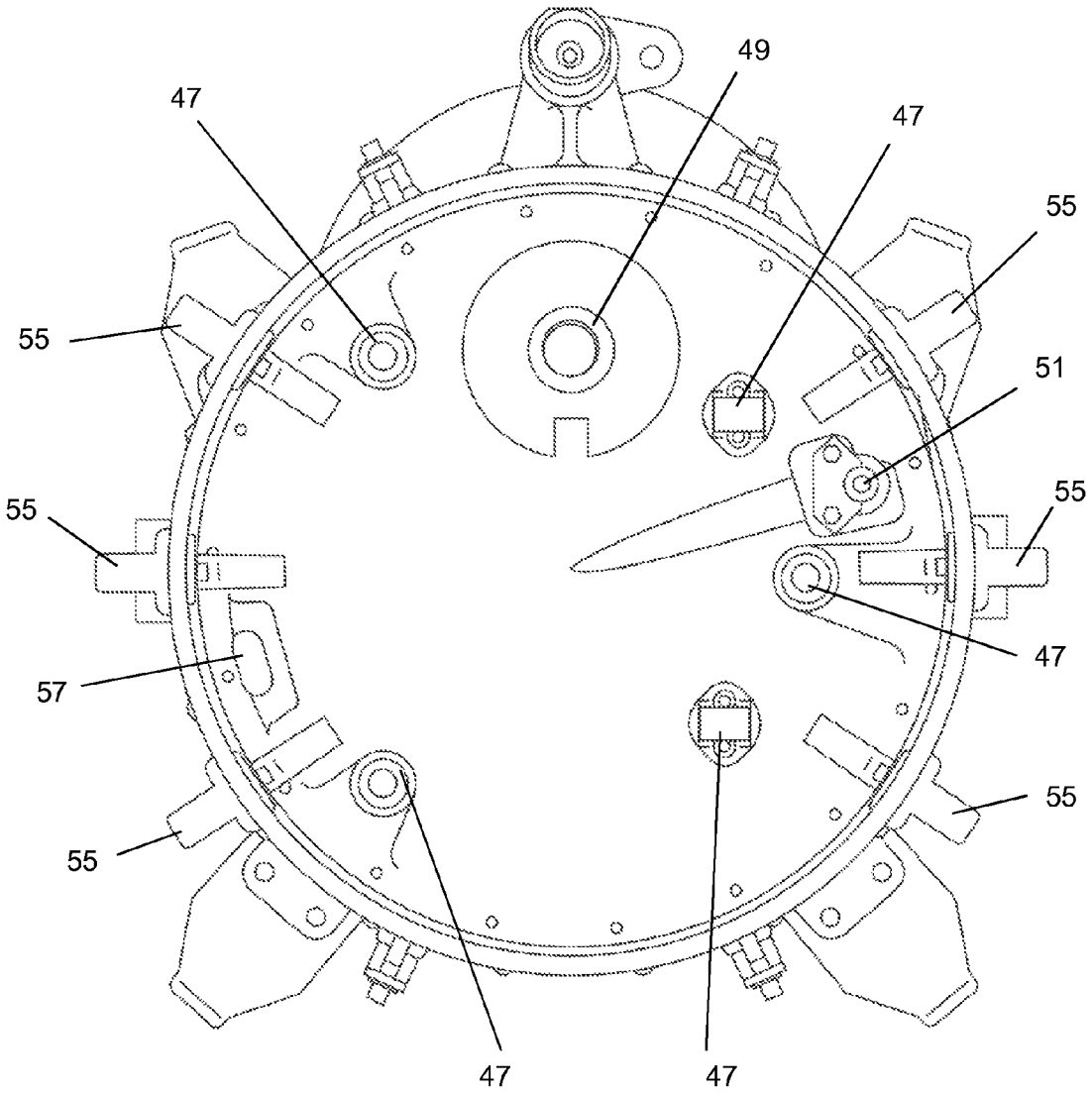
FIG. 5B is a diagram of an interface according to an exemplary embodiment of the present invention.

FIG. 5B illustrates an example of an interface for a diverter switch located within the tap changer housing. Of course, other interfaces are possible, depending on the specific implementation. FIG. 5B illustrates a view from inside the tap changer housing at the interface for the diverter switch. There may a number of mechanical and electrical interfaces for the diverter switch. In an exemplary embodiment, the mechanical interface may include three holes 47 for corresponding guiding pins (not shown) on the diverter switch. The guiding pins on the diverter switch fit into these three holes 47 to help secure the diverter switch within the housing. A drive disk 49 may also be provided on the interface. The drive disk 49 transfers the rotary motion of the motor drive to the diverter switch. An oil pipe 51 is also provided along a wall of the housing. This oil pipe 51 may be used as a guide during mounting of the diverter switch. A glass fiber rib 57 may also be provided along the housing wall. This rib may also be used as a guide during mounting of the diverter switch. In some cases, a glass fiber rib may not be present, for example, in older version UCG's. The vacuum diverter switch may be locked into position as in traditional UCG. For example, by compression springs on a lifting yoke.

Figure 6B:
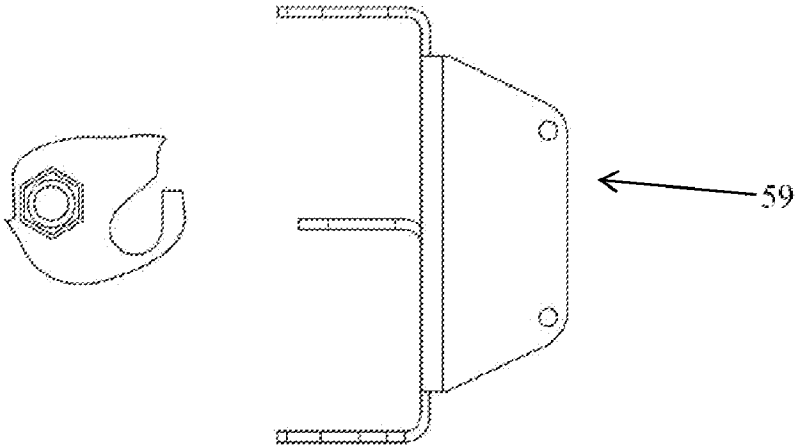
FIG. 6A-6C are diagrams of a lifting yoke according to an exemplary embodiment of the present invention.
Figure 6A:
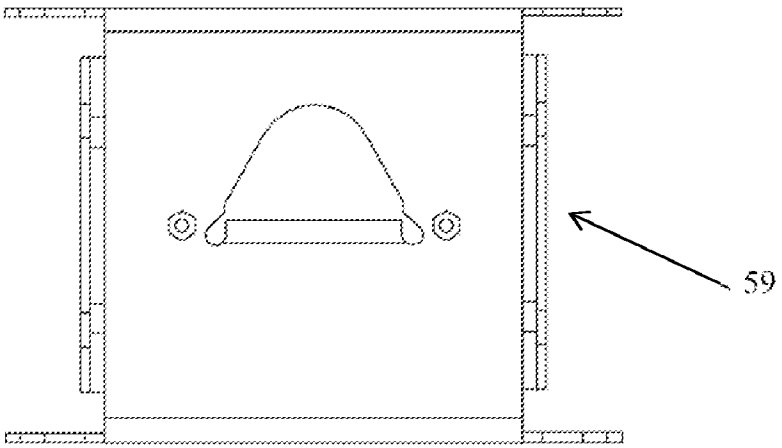
Figure 6C:
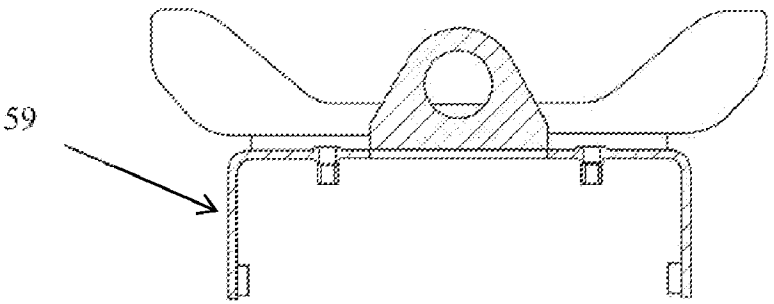

An example of a lifting yoke 59 is shown in FIG. 6. In embodiments of the invention, no special tools are needed to secure the diverter switch in a correct position. The down force from the vertically mounted compression springs on top of the lifting yoke should be sufficient. The lifting yoke may also feature four extra "wings" to prevent faulty mounting of the diverter switch in the housing. Hence, the cover of the housing cannot be tightened if the drive pin on the diverter switch is outside the slot of the drive disk.

In an exemplary embodiment, the electrical interface for the diverter switch may include two bottom plug-in contacts 53 for the neutral point. These contacts 53 are electrically coupled to corresponding contacts on the diverter switch. Additionally, six plug-in contacts 55 for the phases may also be provided. Two contacts 55 for each phase may be provided.

The interface feature makes it possible to change from traditional to vacuum based switching technology without large interference with the transformer. The change can be done in less time than for a normal maintenance, since no cleaning of the old diverter switch is necessary. Without the interface feature it may in most cases be necessary to drain the transformer to perform the exchange. Thus, embodiments of the invention provide a vacuum based diverter switch for retrofitting.

Additional embodiments may provide a diverter switch that may serve a vide range of ratings and applications with as small changes to the diverter switch as possible. For example, the diverter switch may be designed with parts that are easily replaceable. In an exemplary embodiment of the invention, the rating and application range of the tap changer can be modified. This may be done by changing various parts of the diverter switch. In the disclose embodiment, one or more of the transition resistors, lifting rods or connections may be changed. Each of the changes may be made on site or by a customer with the support of standard tools and instructions.

As briefly described above, the transition resistors may be provided as modules 52 of resistors. The modules may include the same number and type of resistors or the modules may be different from each other. The transistor resistors may be changed to change the load rating of the tap changer. The diverter switch may be provided with a standardized mount 54 to receive the transition resistor modules. Each of the transition resistor modules is adapted to interface with the standardized mounting, allowing for easy replacement of the transition resistor modules. The standardized mounting may be disposed. The transition resistor modules may be mounted with different number of resistor modules and different connections between the modules depending on step voltage and rated current.

Figure 7:
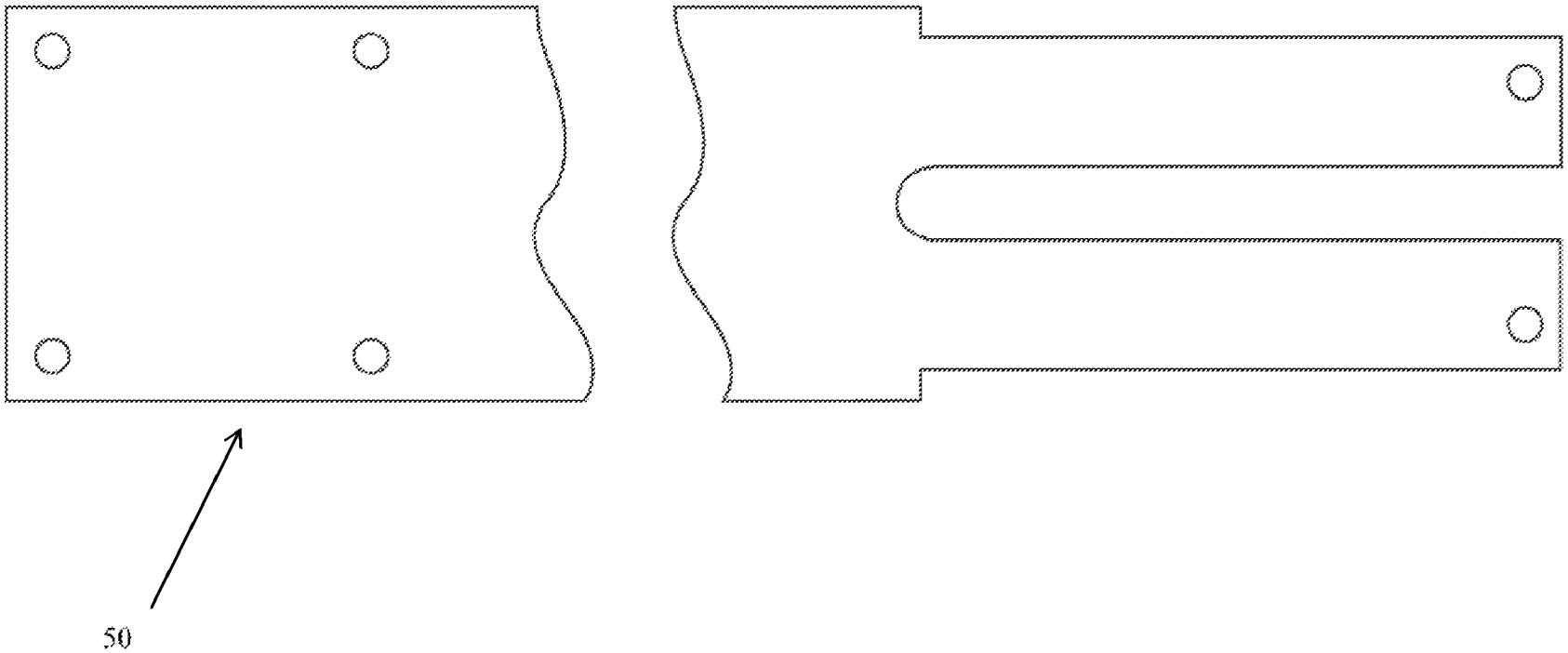
FIG. 7 is a diagram of a lifting rod according to an exemplary embodiment of the present invention.

Embodiments of the invention also provide a diverter switch that may include a standardized mounting for lifting rods. The lifting rods may be changed to change to insulation rating of the tap changer. Lifting rods of various lengths may be provided with an interface that mates with the standardized mounting. Thus, the same mounting may be used independent of the insulating level. Only the length of lifting rod may be changed, depending on the insulating level. The same length for lifting rods can be used for a yoke mounted tap changer (intermediate flange on diverter switch housing with height 106 mm) and tap changer, mounted directly on the cover of the transformer. The difference in length can be accomplished by using different holes for the lifting yoke on top of the lifting rods. This reduces the variants of lifting rods by 50%. An example of the lifting rods 50 is shown in FIG. 7 and by broken lines in FIG. 4.

In an embodiment of the invention, the connections may also be provided. Depending on the application, single phase or star point, a connection is added between resistor packages (normally one package containing more than one resistor module per phase).

While various embodiments of the invention have been described above, it should be understood that they have been presented by way of example, and not limitation. It will be apparent to persons skilled in the relevant art that various changes in form and detail may be made therein without departing from the spirit and scope of the invention. This is especially true in light of technology and terms within the relevant art(s) that may be later developed. Thus the invention should not be limited by any of the above-described exemplary embodiments, but should be defined only in accordance with the following claims and their equivalents.

What is claimed is:

1. A diverter switch for a tap changer, the diverter switch comprising:

a main contact; transition contacts;

a vacuum switch disposed to quench arcing when switching between the main contacts and the transition contacts; and a housing for receiving the diverter switch, wherein the housing includes an interface for the diverter switch, wherein the interface includes: guide holes for pins on the diverter switch, a drive disk, bottom plug-in contacts for neutral point, and plug-in contacts for the phases.

2. The diverter switch according to claim 1, wherein the main contacts and the transition contacts are disposed within the vacuum switch.

3. The diverter switch according to claim 1, further comprising an interface adapted to mate with a tap changer housing.

4. The diverter switch according to claim 1, further comprising an electrical circuit and a mechanical mechanism for switching taps are separated from each other.

5. A diverter switch comprising, an interface to mate with an existing tap changer housing to allow retrofitting of the diverter switch;

main contacts;

transition contacts;

a transition resistor mount coupled to the transition contacts;

a transition resistor module having an interface to mate with the transition resistor mount, wherein a plurality of transition resistor modules may be coupled together; and a housing for receiving the diverter switch, wherein the housing includes an interface for the diverter switch, wherein the interface includes: guide holes for pins on the diverter switch, a drive disk, bottom plug-in contacts for neutral point, and plug-in contacts for the phases.

6. The diverter switch according to claim 5, further comprising:

a standard mount for a lifting rod;

a lifting rod having an interface compatible with the standard mount, the standard mount being adapted to receive lifting rods of varying length.

7. The diverter switch according to claim 5, further comprising a connection configured to connect the resistor modules together, wherein the connection comprises at least one of a star point connection or a single phase connection.

8. The diverter switch according to claim 5, further comprising a vacuum switch disposed to quench arcing when switching between the main contacts and the transition contacts.

9. The diverter switch according to claim 8, wherein the main contacts and the transition contacts are disposed within the vacuum switch.

10. The diverter switch according to claim 5, wherein each of the plurality of transition resistor modules is connected together differently configured connection.

* * * * *